United States Patent [19]

Sulz et al.

[11] Patent Number: 4,688,504

[45] Date of Patent: Aug. 25, 1987

[54] SAILING CRAFT

[75] Inventors: Günter Sulz, Hohenheimer Str. 40, D-7000 Stuttgart 1; Lothar Wessoly, Stuttgart; Wolfgang Thoma, Stuttgart, all of Fed. Rep. of Germany

[73] Assignee: Günter Sulz, Stuttgart, Fed. Rep. of Germany

[21] Appl. No.: 809,431

[22] Filed: Dec. 16, 1985

[30] Foreign Application Priority Data

Dec. 15, 1984 [DE] Fed. Rep. of Germany ..... 3445836

[51] Int. Cl.[4] ..... B63B 1/14

[52] U.S. Cl. ..... 114/39; 114/61; 114/283; 114/284

[58] Field of Search ..... 114/39, 61, 123, 271, 114/280, 284, 283

[56] References Cited

U.S. PATENT DOCUMENTS 1,683,276 9/1928 Woods ..... 114/61
3,116,208 1/1964 Gardhouse ..... 114/123
3,981,259 9/1976 Harper ..... 114/61
4,457,248 7/1984 Thurston ..... 114/39

FOREIGN PATENT DOCUMENTS 7702293 9/1978 Netherlands ..... 114/61

*Primary Examiner*—Joseph F. Peters, Jr.
*Assistant Examiner*—Thomas J. Brahan
*Attorney, Agent, or Firm*—Jones, Tullar & Cooper

[57] ABSTRACT

A sailing craft has a middle float and two lateral pivotable floats joined to it via struts and their joints. The two lateral floats each have two surface regions that can be brought into contact with the surface of the water. One surface region is embodied as a skimming surface and the other surface region is embodied as the outer surface of a displacement float. In a first pivoted position, the surface region forming the outer surface of the displacement float becomes operative at the surface of the water. In the second pivoted position, the surface region acting as the skimming surface becomes operative at the surface of the water.

3 Claims, 7 Drawing Figures

SAILING CRAFT

FIELD OF THE INVENTION

The invention is based on a sailing craft having a middle float and two lateral, pivotable floats that are joined to the middle float via struts and joints.

BACKGROUND OF THE INVENTION

A sailing craft of this type is known from U.S. Pat. No. 3,929,085. By pivoting the outriggers or struts, the idle float when the sailing craft is heeling is forced downward, so as to generate buoyancy to counter the heeling. The outriggers are to be actuated separately from one another in accordance with the heeling. No influence is exerted on the resistance to flow, or drag, in this case.

A further sailing craft of the above type has become known from French laid-open patent application No. 2538339. The subject is a sailing board having articulated laterally offstanding outriggers or struts toward the top, on the ends of which there are floats. The outriggers are joined to the mast and offer the users the opportunity of sitting on them and thus holding the boom with greater strength.

Still another sailing craft of the above type is known from French laid-open patent application No. 2517621. Here, again, the subject is a sailing board, on both sides of which floats can be be attached, in various pivoted positions, by means of an outrigger frame, to make it easier for the users to keep their balance while they are learning to handle the craft. No changes or improvements of any kind are made in the sailing properties of the craft during normal operations.

OBJECT AND SUMMARY OF THE INVENTION

It is an object of the present invention to improve a sailing craft of the above type such that by having variable flow properties, it can sail faster and more safely than known sailing craft.

In accordance with the invention this object is attained, in a sailing craft of the above described generic type, in that the two lateral floats each have two surface regions that can be brought into contact with the surface of the water, one of which is embodied as a skimming surface and the other of which is embodied as the outer surface of a displacement float, and that the surface region that becomes operative at the surface of the water is the one that forms the outer surface of the displacement float, in a first pivoted position of the two lateral floats, and the one that forms the skimming surface, is operative in a second pivoted position of the two lateral floats.

In the sailing craft according to the invention, the floats can be varied in their position in such a way, during sailing, that there is a change from having the floats in the water and effecting displacement to having them skimming on the surfae. If this change is made at a speed at which the skimming resistance becomes less than the displacement resistance, then greater speed is possible, with the same type and size of sails, than can be attained with multiple-hulled boats that are equipped with displacement floats. At the same time, this change can also take place in the opposite direction, that is, from skimming to displacement floating, so that braking is attainable by varying the resistance to flow, or drag.

This is particularly advantageous because it can be brought into effect without the positions of the sails.

Advantageous embodiments and variants of the invention will become apparent from the ensuing description of exemplary embodiments of the invention taken in conjunction with the drawings.

BRIEF DESCRIPTION OF THE DRAWINGS

FIG. 3 shows the exemplary embodiment with its floats 4, 5 hauled in;

DESCRIPTION OF THE PREFERRED EMBODIMENTS

Figure 1:
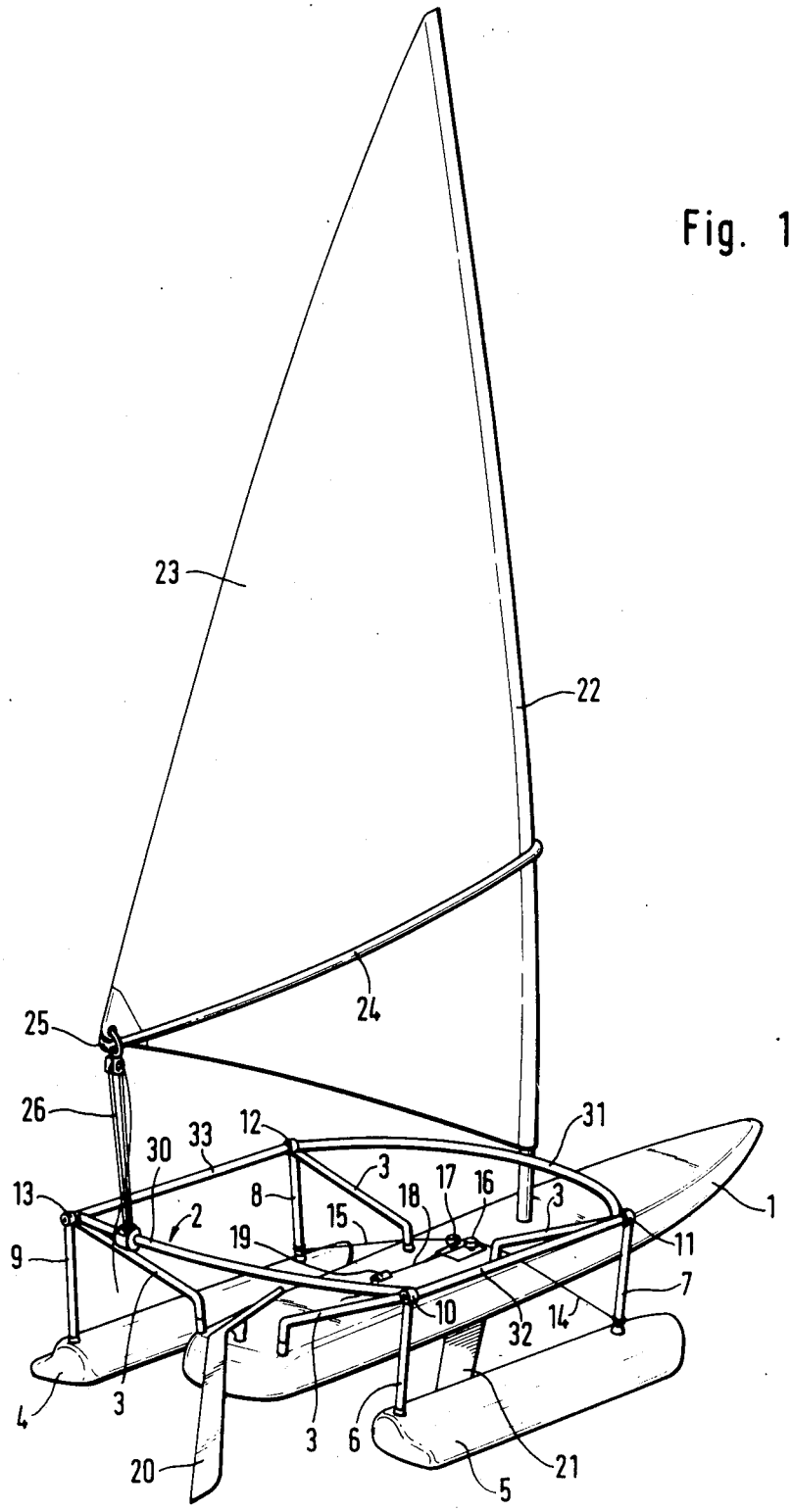
FIG. 1 shows an exemplary embodiment of the invention.

The exemplary embodiment is a sailing craft. It has a middle float 1, on which a frame 2 is secured with the aid of struts 3. The struts extend upward and outward from the top of the float 1. By way of example, they are screwed to the float 1. The middle float 1 may be embodied in the manner of a sailing board, so that the water craft shown can accordingly be manufactured by modifying a sailing board.

The sailing craft has two further, lateral floats 4 and 5. The floats 4 and 5 are secured on the frame 2 such that struts 6, 7 and 8, 9, respectively, which are firmly joined to the floats 4, 5 are articulated on the frame 2 by means of joints 10–13.

The floats 4, 5 are not as long as the middle float 1. Their length is about half that of the float 1. Their position relative to the middle float 1 can be varied during sailing, as may be seen from a comparison of FIGS. 2 and 3.

Varying the position of the floats 4, 5 relative to the middle float 1 is effected in that ropes 14 and 15 are secured to the struts 7 and 8, respectively, or rather to the lower end thereof. Each rope is guided by a respective deflection roller 16 and 17 on the middle float 1. After being deflected the ropes 14, 15 are joined together, and the main rope 18 thereby formed is secured on the middle float by a belaying clamp 19. Depending on how hard the main rope 18 is hauled in (pulled up) or slackened (paid out), the floats 4 or 5 will be drawn up to the middle float 1 or will be able to move farther away from it. The joints 10–13 are embodied such that the struts 6–9, when approximately in the position shown in FIG. 3 (inclined obliquely outward approximately 10° from the vertical) abut against stops, which prevent further inward movement by the struts 6–9, which could cause instability. Theo utward inclination of about 10° on the part of the struts when they abut against the stops (FIG. 3) assures that the buoyancy acting upon the floats 4, 5 will move the floats 4, 5 into the safe outer position (FIG. 2) if the main rope 18 is let loose.

Figure 2:
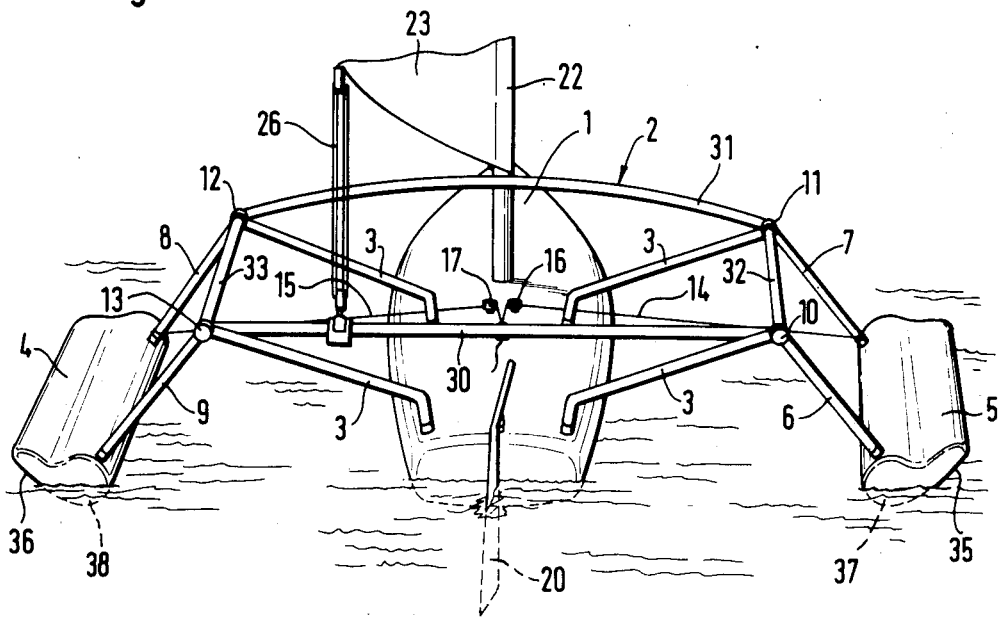
FIG. 2 shows the exemplary embodiment with its floats 4, 5 lowered.
Figure 3:
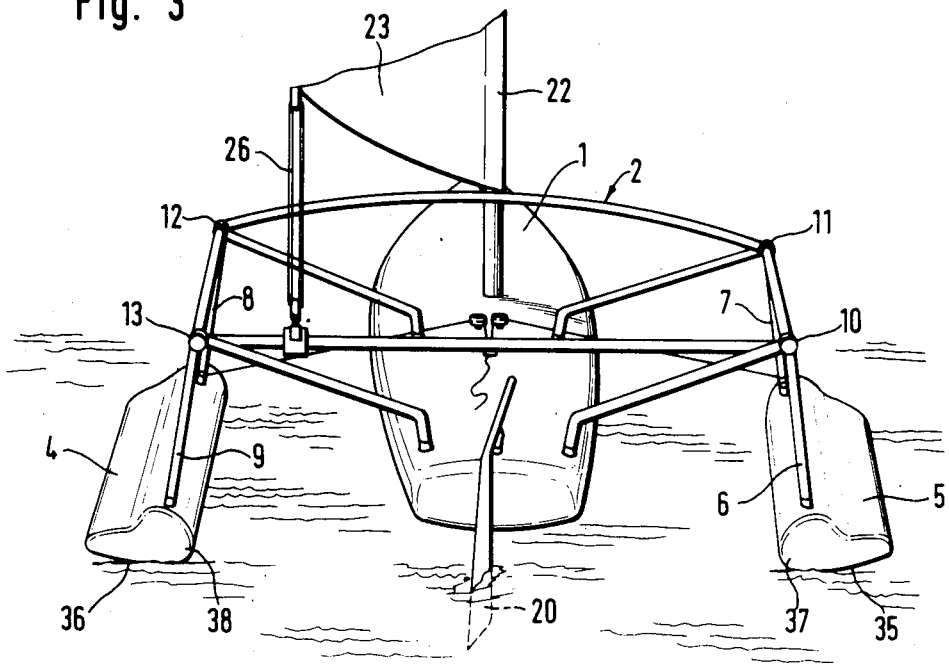
Figure 4:
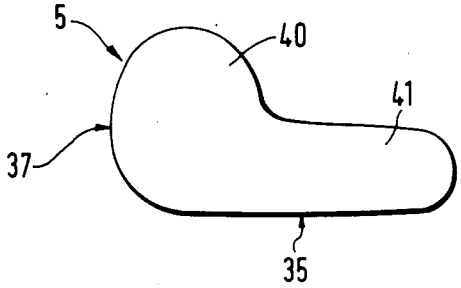
FIG. 4 is a cross section of a float 5.

The sailing craft also has a rudder 20, a centerboard 21, a mast 22, a sail 23, and a boom 24 movably attached to the mast, the rear end 25 of the boom being attached via a sheet 26 to the rear strut 30 of the frame 2. The struts 30, 31, 32, 33 form the frame 2. The frame 2, the struts 3, 6–9 and the joints 10–13 form a rod linkage system for adjusting the floats 4, 5. The frame furthermore enables securing shrouds at the points at which joints 11, 12 are provided, and setting up a foresail. As seen in FIGS. 2 and 3, the floats 4, 5 have skimming surfaces 35 and 36, respectively. On the side toward the float 1, they merge with outer surfaces 37 and 38, hereinafter called displacement surfaces, of a displacement float. The arrangement is such that in the pivoted position of FIG. 2, that is, with the outriggers lowered, the displacement surfaces 37 and 38 dip into the surface of the water, while in the hauled-in position of the outriggers shown in FIG. 3, the skimming surfaces 35, 36 are parallel to the surface of the water. In this manner, by varying the position of the floats 4, 5, the type of float surface of the floating cross section of the outrigger that is in cotnact with the surface of the water can be varied, and thus—depending on the speed—the type of flow around the floats 4, 5 can be varied. This change in the operative surfaces of the floats 4, 5, or of their operative cross sections in the water, is effected in the exemplary embodiment as described, that is, that the struts 6–9 joined to the outriggers are pivotable on the frame 2 via the joints 10–13.

Simultaneously with the pivoting of the floats 4, 5 in order to vary the surface that is operative on the water, the position of these floats 4, 5 relative to the middle float 1 also varies. On the precondition that in the embodiment of the frame 2 as shown the struts 6–9 are longer than the distance by which the frame 2 is above the surface of the water, then when the floats 4, 5 are hauled in (raised), the float 1 rises up out of the water. It is then located above the surface of the water.

With the aid of the change in position of the floats 4, 5 relative to the middle float 1, it is accordingly possible to attain the following:

(a) in the position shown in FIG. 2, all three floats 1, 4, 5 act as displacement floats;

(b) in the second position (FIG. 3), the floats 4, 5 operate as skimmers, while the middle float 1 is raised up out of the water.

Every stage in between these two positions is also attainable. The advantage of this change in position of the floats and of the basis of support on the surface of the water is very great stability. The stability of the sailing craft operating as a skimmer, in which the floats 4, 5 act as skimmers and the float 1 is raised up out of the water (FIG. 3), is considerably greater for instance than that of a single sailing board having only one float acting as a skimmer. For this reason, the sails used can be much larger in size than is the case with a sailing board or a sailing yawl, for instance, although in the skimming state (FIG. 3) the skimming surfaces are considerably smaller and hence drag is considerably less. Thus it is possible to attain very much higher speeds, despite increased safety (that is, increased stability and better braking).

The lengths of the floats shown are proportioned such that the front part of the middle float 1, by means of the buoyancy forces it produces, due to the longer lever length, counteracts tendencies toward instability.

Furthermore, the sailing craft embodied according to the invention is easy to construct, beginning with a sailing board available on the market, by securing the frame 2 and the further pivotably articulated floats 4, 5 to the sailing board. A single-hulled sailing craft can also be equipped with this arrangement.

Figure 5:
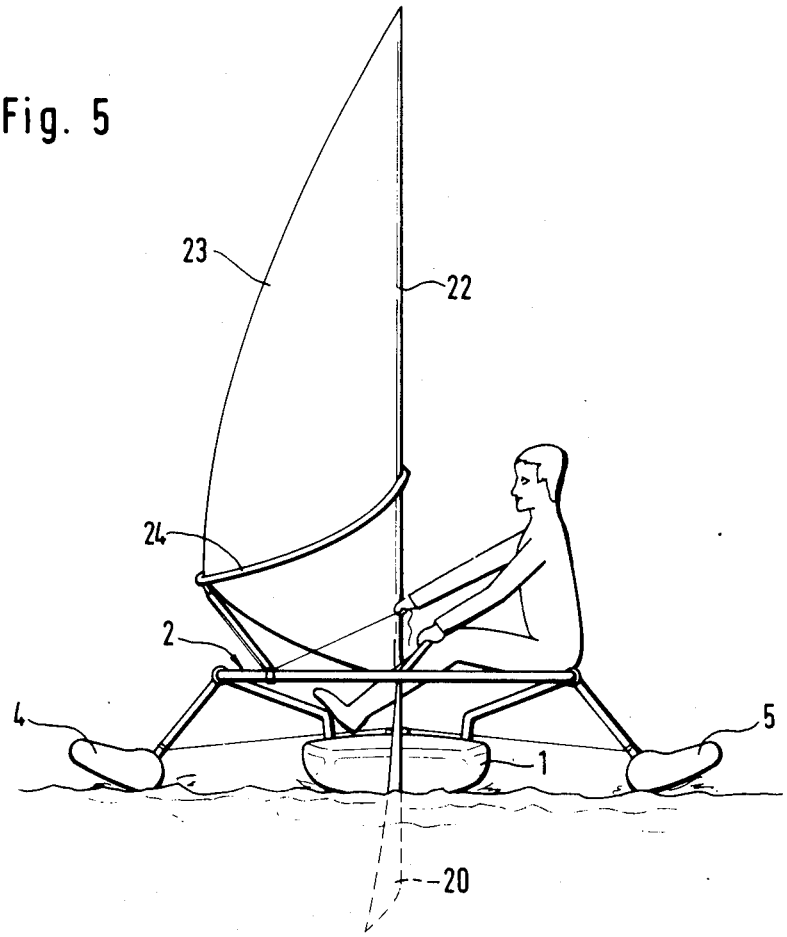
FIG. 5 is a schametic representation of sailing with such a craft.

FIG. 5 shows that the water craft embodied according to the invention can be sailed like a yawl. One person can sit on the frame 2. It is also possible to sail this water craft with two persons, however. Thus it is particularly suitable for family recreational sports, especially in view of the fact that one component is a float that, without the other equipment, can be used by an individual as a sailing board and then, with the additions according to the invention, can be used as a two-person recreational apparatus.

A particular advantage of the arrangement shown is that the frame 2 and thus the floats 4, 5 can be unscrewed and hence disassembled particularly quickly. This considerably facilitates it being transported on land.

It should also be noted that the adjustment of the floats 4, 5 with respect to the float 1 can be effected by other tensile elements, such as linkage rods, instead of by ropes as in the exemplary embodiment shown.

Figures 6, 7:
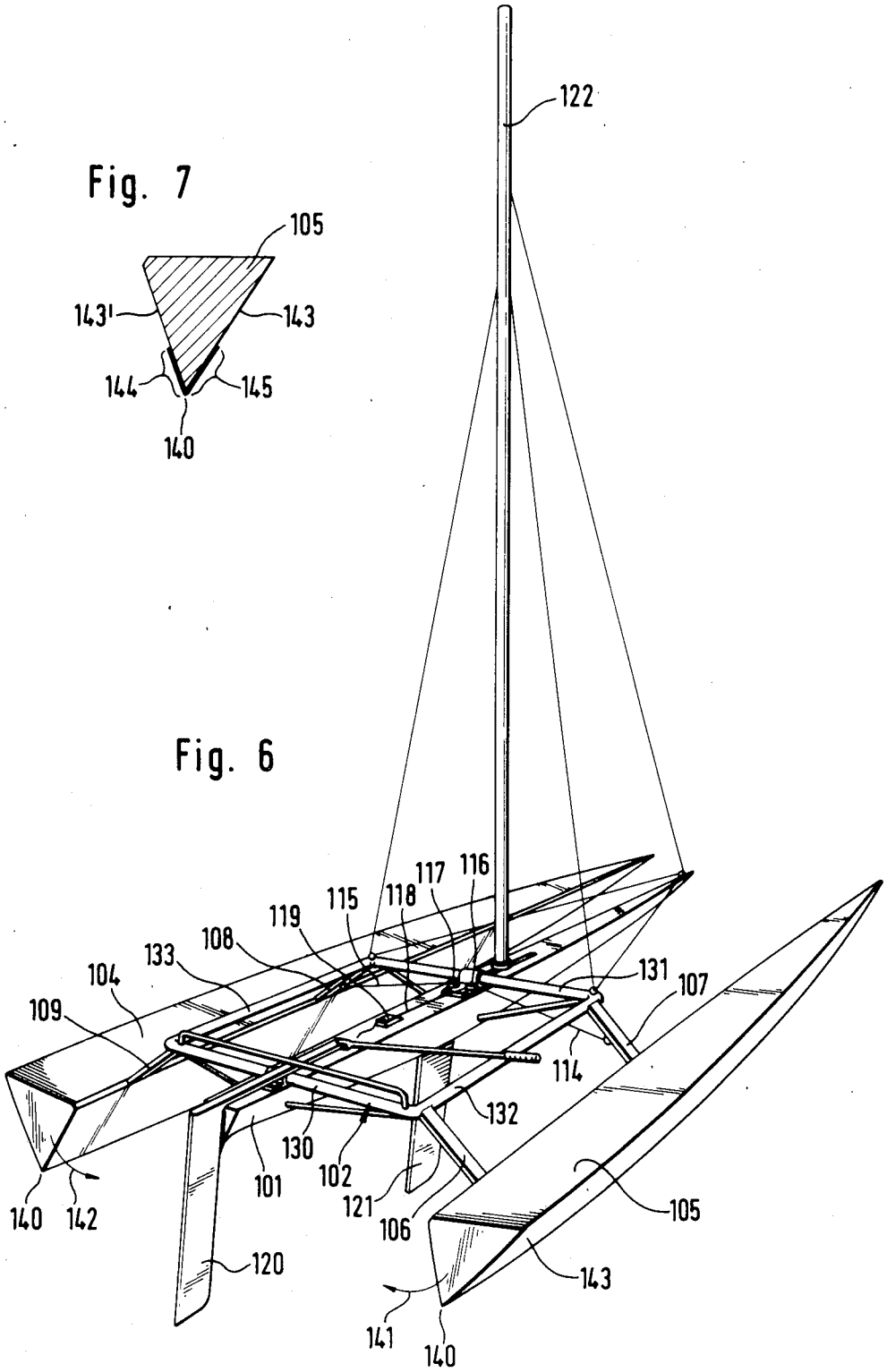
FIG. 6 shows a further exemplary embodiment.
FIG. 7 is a cross section of the right-hand float 105 in the exemplary embodiment of FIG. 6.

FIG. 6 shows a second exemplary embodiment. The substantial difference between it and the exemplary embodiment of FIGS. 1–5 is that a middle float in the strict sense is no longer used. The middle float is replaced by a spar 101. This spar no longer has any function as a displacement float or skimmer; instead it serves solely to receive the rudder 120, the centerboard 121, the mast 122 and the frame 102. The frame 102 is formed by transversely extending struts 130 and 131. They are joined together by two further struts (not shown) to form an approximately four-sided frame 102. Pipes 132 and 133 are pivotably attached via these further struts that are not shown. The struts 106, 107, 108, 109 which support the two lateral floats 104 and 105 are located on these pipes 132 and 133. The ropes 114, 115, which are deflected at the rollers 116, 117 and then combined into a main rope 118 that is fixed at a belaying clamp 119, engage the struts 107 and 108, respectively.

Each of the two floats 104, 105 can be operative as floats in two positions. To explain this, the cross section of the right-hand float 105 is shown once again in FIG. 7.

In the position shown in FIG. 6, the floats 104 and 105 dip into the water with the downwardly pointing edge or tip 140 of their substantially triangular cross section shown in FIGS. 6 and 7. They then act as displacement floats.

If the main rope 118 is pulled up and the floats 104 and 105 thereby hauled in, that is if they are pivoted inward in the direction of the arrows 141 and 142 with respect to the position shown in FIG. 6, then the results is a position in which the lateral surface 143 is parallel to the surface of the water and thus acts as a skimming surface.

In the sense of the terminology that was used for the first exemplary embodiment, the lower regions 144, 145 in FIG. 7 of the lateral surfaces 143 and 143', respectively, which have been shown in FIG. 7 in somewhat heavier lines than the remaining surface regions represent the outer surface of a displacement float. By contrast, the lateral surface 143, including the lower region 145, is the one that is embodied as a skimming surface and becomes operative in the second position.

What is claimed is:

1. A sailing craft comprising:

a middle spar including a middle float;

a rudder, a centerboard and a mast supported by the middle spar;

a rigid frame supported by the middle spar and extending in a lateral direction of the middle spar;

at least two rods pivotally linked to each side of the frame, said rods having a length from their pivotally linked ends to free ends thereof greater than the vertical distance of the middle spar from the frame; and two floats, one on each side of the middle spar, each connected to the free ends of the rods on its respective side of the middle spar, wherein each float has two surface regions that can be brought into contact with the surface of the water by pivoting the rods with respect to the frame, one of said surface regions serving as a skimming surface and the other of said surface regions serving as the outer surface of a displacement float, such that when pivoting the rods from a laterally inclined position, in which the surface regions acting as displacement surfaces are effective, into a substantially vertical position, in which the skimming surfaces are effective, the skimming surfaces will be the only surfaces of the craft in contact with the water, wherein said middle float engages the water when the displacement surfaces are effective.

2. The sailing craft as defined in claim 1, wherein the skimming surface region is contiguous with the displacment float float surface region when viewing the lateral floats in transverse cross-section.

3. The sailing craft as defined in claim 1, wherein the transverse cross section of each float is substantially triangular, two lateral surfaces thereof merging to define an edge of the triangle, with the portions of the lateral surfaces at said edge serving as the displacement float surface region, and with the remaining portion of one of the lateral surfaces serving as the skimming surface region.

* * * * *